US006694894B1

(12) United States Patent
Darnell

(10) Patent No.: US 6,694,894 B1
(45) Date of Patent: Feb. 24, 2004

(54) LOAD-AND-ROLL PALLET

(75) Inventor: James R. Darnell, Tinley Park, IL (US)

(73) Assignee: C.M.I. Freight-Trans, Inc., Chicago, Ridge, IL (US)

( * ) Notice: Subject to any disclaimer, the term of this patent is extended or adjusted under 35 U.S.C. 154(b) by 19 days.

(21) Appl. No.: 10/100,586

(22) Filed: Mar. 18, 2002

(51) Int. Cl.[7] ..... B65D 19/00

(52) U.S. Cl. ..... 108/53.1; 108/55.1; 108/57.17

(58) Field of Search ..... 108/51.11, 53.1, 108/53.3, 55.1, 55.5, 57.15, 57.17, 57.19, 57.2, 57.32

(56) References Cited

U.S. PATENT DOCUMENTS

| | | | | | |
|---|---|---|---|---|---|
| 493,980 | A | | 3/1893 | Coller | |
| 577,471 | A | | 2/1897 | Ward | |
| 1,522,707 | A | | 1/1925 | Andrews et al. | 108/55.1 X |
| 1,574,501 | A | | 2/1926 | O'Brien | 108/55.1 X |
| 1,742,384 | A | | 1/1930 | Fitzgerald, Jr. | 108/51.1 X |
| 2,113,346 | A | | 4/1938 | Heath | 297/325 X |
| 2,152,086 | A | | 3/1939 | Powell | 108/57.1 |
| 2,246,882 | A | | 6/1941 | Gentry | 414/426 |
| 2,498,146 | A | | 2/1950 | Trotter | |
| 2,534,010 | A | | 12/1950 | Frye | 108/55.1 X |
| 2,649,217 | A | | 8/1953 | Mertes | |
| 2,664,219 | A | * | 12/1953 | Schmidt | 220/1.5 |
| 2,687,310 | A | | 8/1954 | Goetz | 108/55.1 X |
| 2,716,872 | A | | 9/1955 | Test | |
| 2,744,710 | A | | 5/1956 | Gerosa | 248/129 |
| 2,828,040 | A | | 3/1958 | Fitton et al. | 108/55.1 X |
| 2,841,302 | A | | 7/1958 | Reisman | 108/55.1 X |
| 2,923,512 | A | * | 2/1960 | Campbell | 108/55.5 |
| 2,947,565 | A | | 8/1960 | Wood | 108/55.1 X |
| 3,025,058 | A | | 3/1962 | Brumfield | 248/129 X |
| 3,118,400 | A | | 1/1964 | Kemp, Jr. et al. | 108/57.1 |
| 3,259,432 | A | | 7/1966 | Jackson | 248/129 X |
| 3,294,041 | A | | 12/1966 | Lessheim | 108/51.1 |
| 3,297,175 | A | | 1/1967 | Gooding | 108/55.1 X |
| 3,429,536 | A | | 2/1969 | Petry et al. | 108/55.3 |
| 3,602,157 | A | | 8/1971 | Cohen | 108/51 |
| 3,651,970 | A | | 3/1972 | Black | 214/515 |
| 3,667,635 | A | | 6/1972 | Hackney | 214/515 |
| 3,726,424 | A | | 4/1973 | Du Puis et al. | 214/620 |
| 3,729,215 | A | | 4/1973 | Paakkinen | 280/425 A |
| 3,753,407 | A | | 8/1973 | Tilseth | 108/53 |
| 3,817,413 | A | | 6/1974 | Ham | 214/515 |
| 3,837,663 | A | | 9/1974 | Ness | 280/8 |
| 3,882,796 | A | | 5/1975 | Andreini et al. | 108/51 |
| 3,883,020 | A | | 5/1975 | Dehn | 214/515 |
| 3,938,678 | A | | 2/1976 | Kern | 214/38 |
| 4,159,060 | A | | 6/1979 | Buse | 414/608 |
| 4,231,695 | A | | 11/1980 | Weston, Sr. | 410/69 |
| 4,240,555 | A | | 12/1980 | Jurasek | 206/511 |
| 4,344,368 | A | | 8/1982 | Remington et al. | 108/51.1 |
| 4,347,794 | A | | 9/1982 | Nordstrom | 108/51.1 |
| 4,416,385 | A | | 11/1983 | Clare et al. | 220/1.5 |
| 4,730,732 | A | * | 3/1988 | Wagonseller | 206/597 |
| 4,799,840 | A | | 1/1989 | Van Gompel et al. | 410/42 |
| 4,801,228 | A | * | 1/1989 | Van Gompel | 410/94 |
| 4,834,000 | A | | 5/1989 | Darnell et al. | 108/51.1 |
| 4,976,365 | A | * | 12/1990 | Seo | 220/1.5 |
| 5,170,721 | A | | 12/1992 | Troth et al. | 108/51.1 |
| 5,355,813 | A | | 10/1994 | Darnell et al. | 108/553 |
| 5,533,456 | A | * | 7/1996 | Regina | 108/57.29 |
| 5,676,066 | A | * | 10/1997 | Cavalier et al. | 108/55.1 |
| 6,585,224 | B1 | * | 7/2003 | Schmidt | 248/640 |

FOREIGN PATENT DOCUMENTS

| | | | |
|---|---|---|---|
| JP | 62-16932 | * | 1/1987 |

* cited by examiner

*Primary Examiner*—Janet M. Wilkens
(74) *Attorney, Agent, or Firm*—Gerald S. Geren; Barnes & Thornburg

(57) ABSTRACT

A pallet of the load-and-roll type having a frame constructed to carry sheet steel of varying widths, being light weight, stackable and nestable for unloaded return shipment. The pallet defines a front or roller end, a back or lift end, two sides and a top surface. The pallet includes frame members and peripheral arms and side rail members. A vertical roller is provided at each corner of the pallet to assist in moving the pallet into and out of lading carrying container.

16 Claims, 6 Drawing Sheets

12
18
20
26
28
30
38
40
42
44
54
56
60
72
74
78
86
88

LOAD-AND-ROLL PALLET

BACKGROUND OF THE INVENTION

This invention relates to lading carrying pallets that can be rolled into a lading carrying container or the like and more particularly to a pallet/frame structure for carrying sheets of steel.

Pallets for carrying lading are well known and widely used. A rollable load-and-roll style pallet is disclosed in U.S. Pat. No. 4,834,000. The pallet disclosed in that patent is generally rectangular and elongated, with a roller front end, a fork lift back end, a pair of sides and a top surface. The pallet as disclosed has a frame construction which includes an elongated center I-beam that extends from one end to the other, a flat wooden deck that forms the upper or lading engaging surface which rests on the frame and I-beam, supports for engaging the lading-container floor and pair of front rollers. Thirty-five references are cited in that patent which disclose various types of systems.

Another type of load-and-roll style pallet is shown in U.S. Pat. No. 5,355,813. The pallet disclosed therein includes a well or depression within which a steel coil can rest for securement and shipment. This well is generally transverse to the direction of the shipment so that the coil axis is also transverse. The coil is placed on the pallet and then the pallet and coil are loaded on a flat bed trailer or similar surface. Rollers are on the pallet at one side and the forklift receiving pockets are on the opposite side.

Often steel is to be shipped in the form of flat sheets (e.g. 4'×16', or 6'×16' etc.) rather than coils. The ability to pre-load the pallet with the sheets and then efficiently load it into or onto a lading carrier is important.

The pallet disclosed in U.S. Pat. No. 5,355,813 is designed for coils, includes a coil receiving depression and maybe too small for larger sheets. The pallet disclosed in U.S. Pat. No. 4,834,000 is flat so it can carry sheets but has a wooden decking over a frame, is heavy to lift and may not include a frame that is structurally sufficient for very heavy loads.

Moreover, after shipment when the pallets are unloaded they are shipped back to the point of origin or elsewhere for reloading. The existing pallets can be relatively thick and only a few pallets can be stacked one-on-one another for shipping.

An object of this invention is to provide a load-and-roll style pallet that is of a light weight construction.

Another object is to provide a load-and-roll style pallet that is constructed to carry heavy loads of large sheet steel.

Yet another object is to provide a load-and-roll style pallet that it is sufficiently flexible to receive loads of various widths.

A further object of the invention is to provide a load-and-roll style pallet which can be efficiently stacked for return of a maximum number of pallets.

These and other objects of this invention will become apparent from the following description and the appended claims.

SUMMARY OF THE INVENTION

There is provided by this invention a load-and-roll style pallet that meets the foregoing objects. The pallet is comparatively light in weight, has only a frame structure and does not have a deck, it is constructed to carry sheet steel lading of various widths and is stackable and nestable for unloaded return shipment.

The pallet is elongated and rectangular and a has a roller at the front end, a back end, a pair of sides, a lading supporting top surface and fork lift tine receiving pockets at the back end and along the sides. The pallet includes two spaced transverse and tubular frame members that extend from one side to the other and are positioned between the ends at about the ⅓ and ⅔ positions lengthwise. The pallet also includes two (2) longitudinal and tubular frame members that extend from one end to the other end, intersect the transverse frame members at substantially right angles and are positioned between the sides at about the ⅓ and ⅔ positions widthwise.

A roller system is located at the front end between the longitudinal frame members and the roller's axis of rotation is transverse to the longitudinal frame members. The back end of each longitudinal frame member forms a lift pocket for engagement by a forklift tine. Each of the ends of the transverse members define lift pockets for engagement by forklift tines from the sides.

A peripheral arm (which is tubular) extends from each longitudinal frame member at each end outwardly or toward an adjacent pallet side. A plurality of peripheral and tubular side rails extend from the outboard end of each peripheral arm to the adjacent transverse frame member. Side rails also extend between the adjacent ends of the transverse frame members.

Tie down or hold down brackets are secured to the outboard sides of each longitudinal frame member. Angle iron supports and nesting guides are secured to the frame where a longitudinal frame member intersects a transverse frame member and also adjacent the front and back ends. One leg of the angle iron extends above the top surface of the pallet and is used as a guide when the pallets are nested and stacked.

A vertically positioned roller is positioned at each pallet corner for use in guiding pallet into and out of a lading carrying container.

DESCRIPTION OF THE PREFERRED EMBODIMENT

Figure 1:
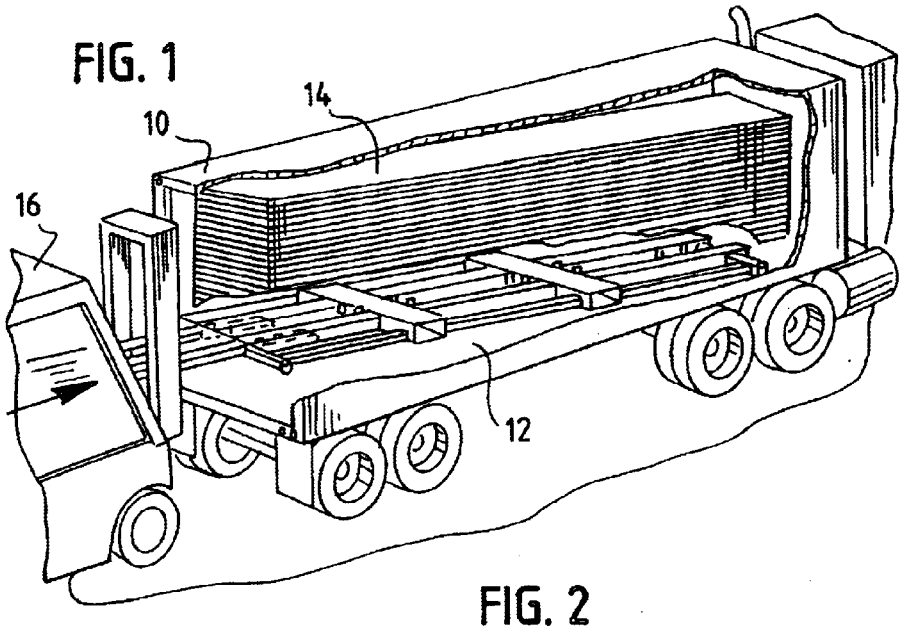
FIG. 1 is a perspective and diagrammatic style view showing a pallet loaded with sheet steel being positioned within a trailer type of container.

Referring now to the drawings and particularly FIG. 1, there is shown a trailer 10 into which a pallet 12 generally on which is a stacked load of sheets 14 generally is being rolled. A forklift 16 generally is shown as having engaged the back end of the pallet, lifting the pallet and rolling the loaded pallet into the container. The pallet will be lowered and the container then shipped.

Figure 7:
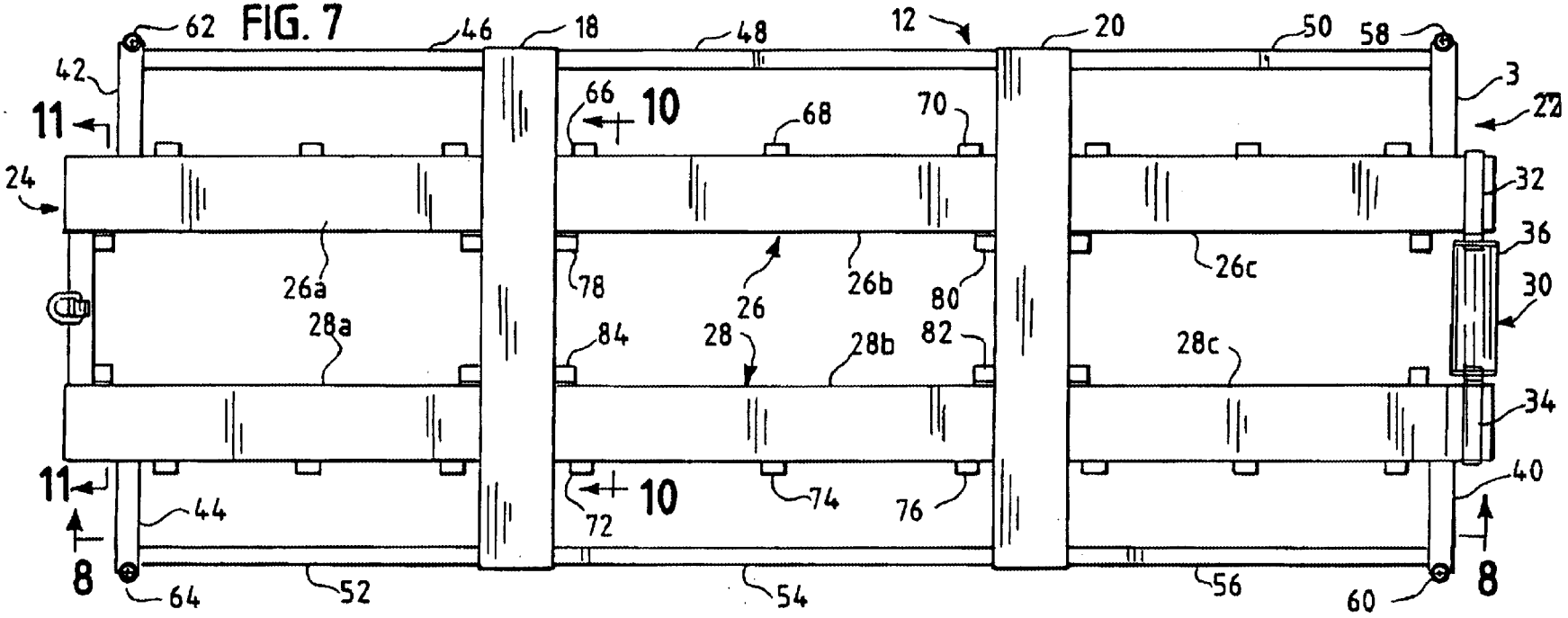
FIG. 7 is a plan view of an unloaded pallet showing the longitudinal frame members, the transverse frame members, the roller front end and the back end.
Figure 8:
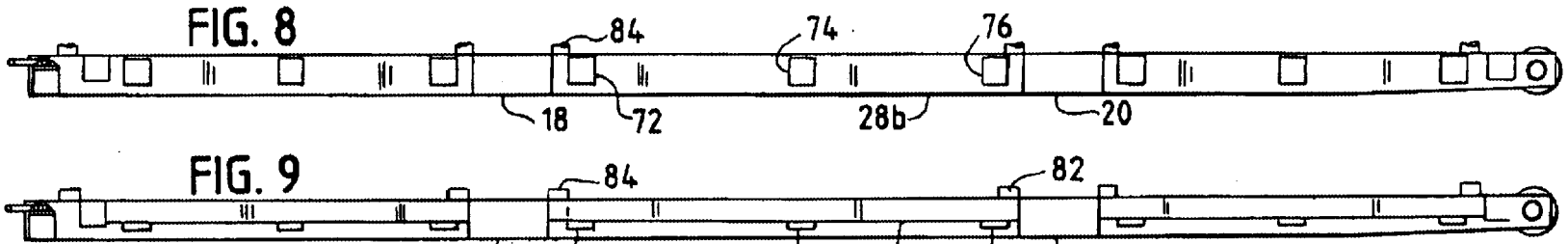
FIG. 8 is a side sectional view taken along the line of 8—8 of FIG. 7 showing a side section of the pallet.
Figure 9:
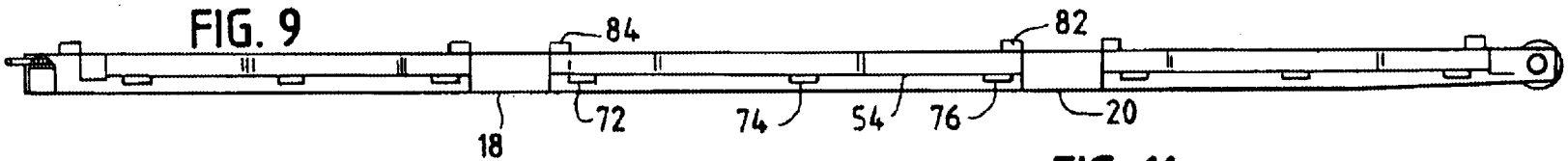
FIG. 9 is a view similar to FIG. 8 showing a side elevational view of the pallet.
Figure 11:
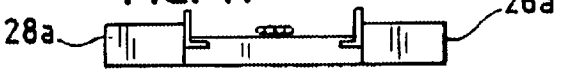
FIG. 11 is a sectional view taken along the line 11—11 of FIG. 7 showing the back end of the pallet.
Figure 10:
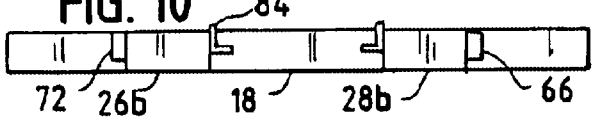
FIG. 10 is a view taken along the line 10—10 of FIG. 7 showing a sectional view of the longitudinal frame members of the pallet and the related angle irons.
Figure 12:
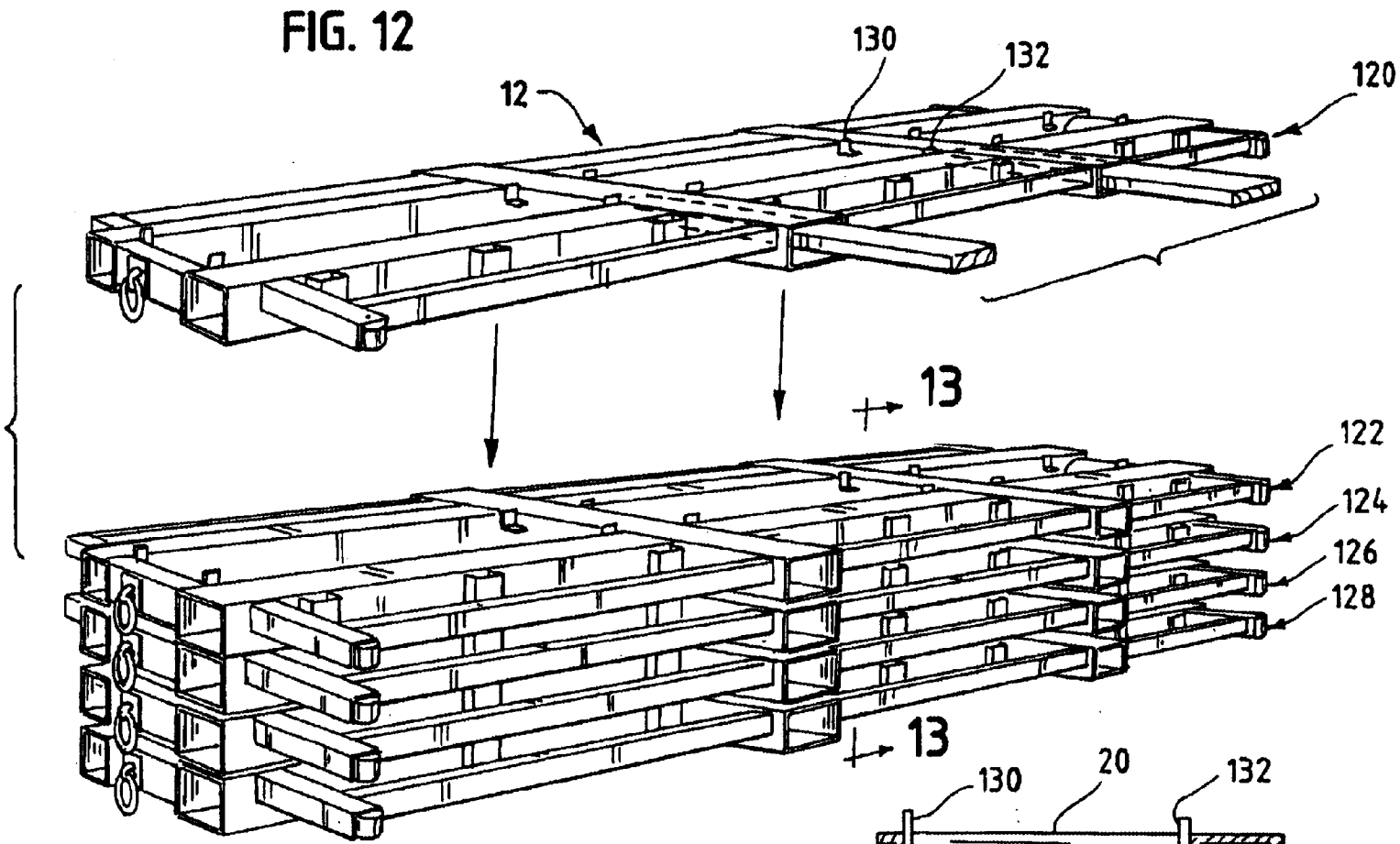
FIG. 12 shows the pallets being loaded on top of one another from one side.
Figure 13:
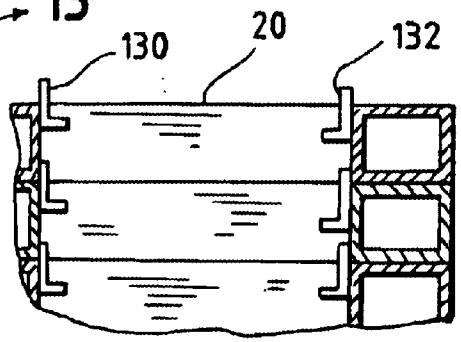
FIG. 13 is a sectional view taken along line 13—13 of FIG. 12 showing a nesting of several pallets.
Figure 14:
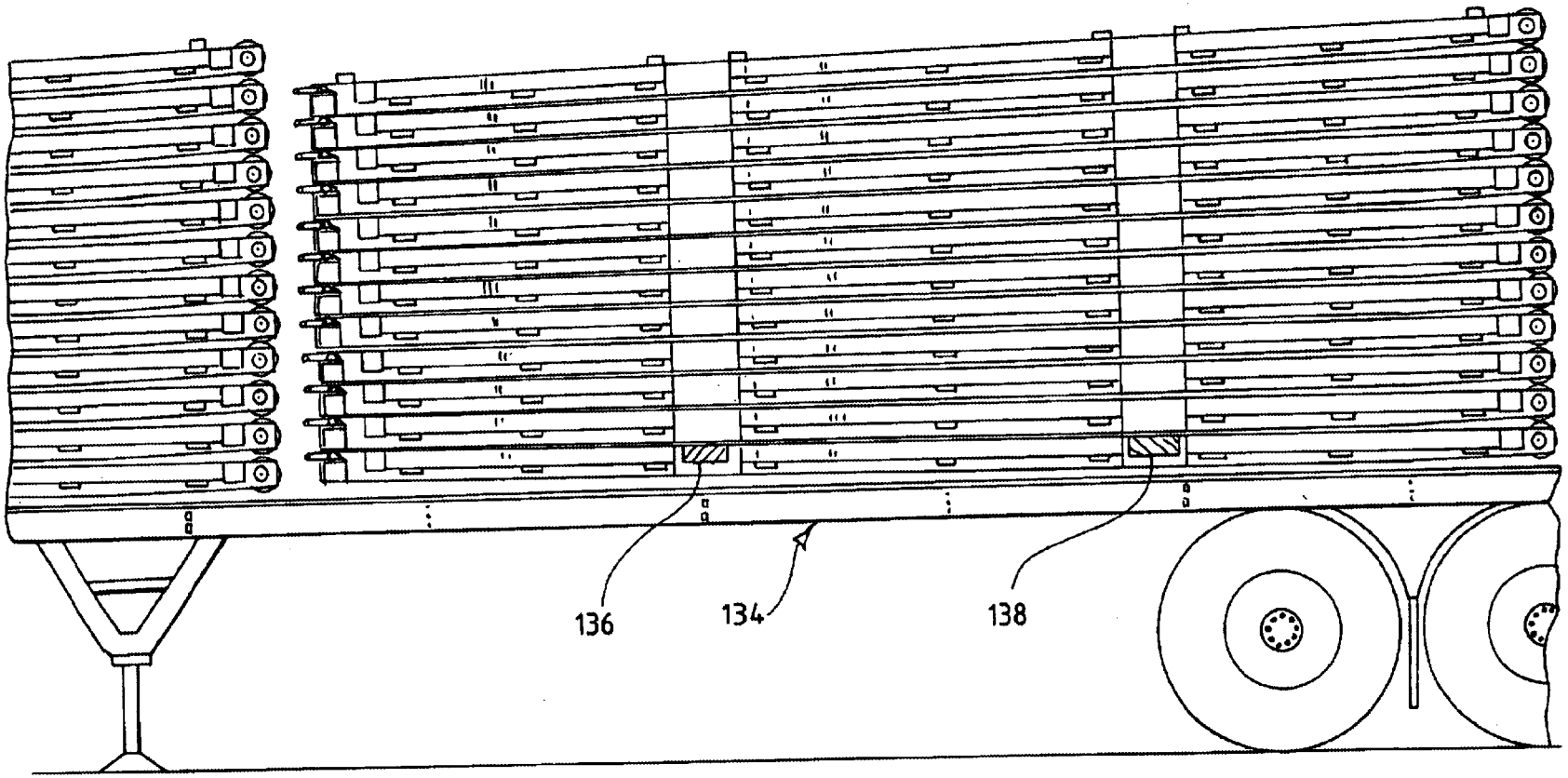
FIG. 14 is a side elevational view showing two sets of stacked pallets on a flat bed trailer and for return shipment to be reloaded.

The pallet itself can be seen in FIG. 7. The pallet 12 generally is an elongated rectangularly shaped member. The pallet is a frame like construction that includes a pair of tubular transverse frame members 18 and 20 which extend from one pallet side to the other side and are positioned lengthwise or longitudinally between the front or roller end 22 and the back or forklift end 24 at about ⅓ and ⅔ positions. Two longitudinal or central frame members 26 and 28 extend from the roller end to the forklift end and are positioned transversely or widthwise between the sides of the pallet at about the ⅓ and ⅔ positions. The longitudinal frame members 26 and 28 are about 20 inches apart and the distance to the outboard sides of the frame members is about 48". The longitudinal frame members 26 and 28 intersect the transverse members 18 and 20 and may be formed in sections 26*a*, 26*b*, 26*c*, 28*a*, 28*b*, and 28*c* which are secured by welding to the transverse members 18 and 20. It will be understood that the transverse members 18 and 20 as well as the longitudinal members 26 and 28 are elongated and hollow steel tubes.

It is seen that the front roller assembly 30 includes a pair of shafts 32 and 34 which are each secured to one of longitudinal or elongated frame members 28*c* or 26*c* and a roller 36 is journalled to the shaft ends and positioned between the frame members 28*c* and 26*c*.

A peripheral frame is formed and secured to the transverse and the longitudinal frame members. The peripheral frame includes four (4) peripheral arm members 38, 40, 42 and 44 each of which are secured at one end to an end of a longitudinal frame member and extend outwardly therefrom toward the adjacent or nearest pallet side, and in a direction substantially parallel to the transverse frame members. In addition, there are provided side rail members 46, 50, 52 and 56 which connect the peripheral arms and adjacent transverse member ends. For example side member 46 connects the arm member 42 to the transverse frame member 18. Side peripheral rail member 48 connects two transverse members 18 and 20 as shown. In a similar manner, side member 54 interconnects the other adjacent ends of the transverse and members 18 and 20.

At each corner of the pallet such as 38 there is provided a vertical roller such as 58, 60, 62 and 64. The rollers are vertically mounted or have a vertical axis of rotation and assist in loading and unloading the pallet by rolling against a side wall if a side wall is engaged.

The pallet also includes eighteen (18) hold down brackets such as 66, 68, 70, 72, 74 and 76 which are U-shaped brackets welded to the outboard side of the longitudinal members, such as 26*b* or 28*b* and to which tie downs can be secured so as to hold lading down against the pallet. Such tie down brackets are provided in connection with each of the longitudinal frame member sections 26*a*, 26*b*, 26*c*, 28*a*, 28*b* and 28*c* and are positioned on the outboard side of the longitudinal frame members.

Angle iron members such as 78,80, 82 and 84 are welded on the inboard side of each elongated frame member adjacent the transverse member and at the front and back ends. Each angle iron is positioned so that it's vertical leg extends about 1 inch above the transverse and longitudinal frame members. Each angle iron's horizontal portion extends inwardly.

The construction of the pallet is also be seen in FIGS. 8–11 generally.

Figures 5, 5A, 6:
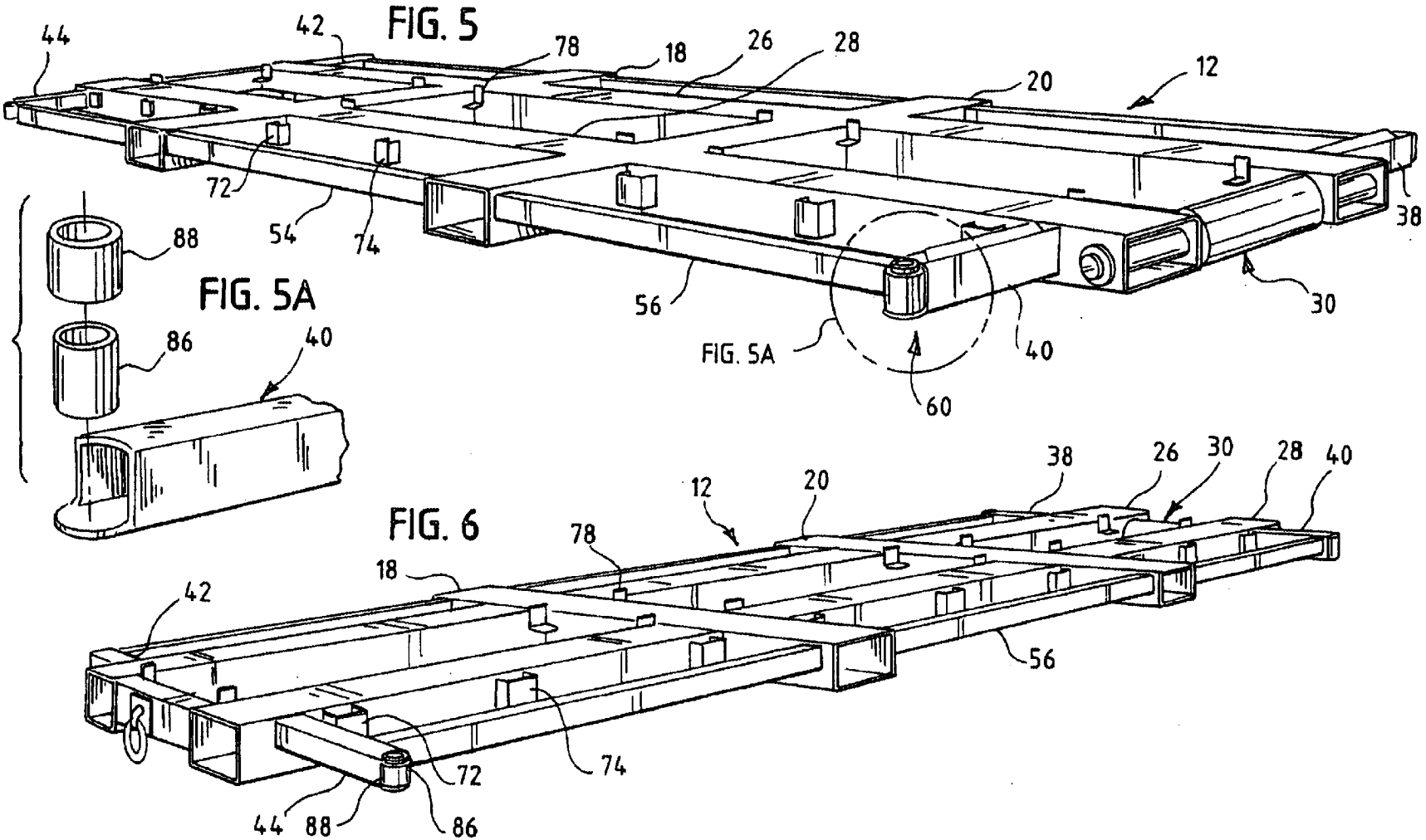
FIG. 5 is a perspective view taken from the roller end of the pallet showing the front roller, a side rails and tine receiving side pockets.
FIG. 5*a* is an exploded perspective view showing the construction of a vertical roller system that is located at each pallet corner.
FIG. 6 is a perspective view similar to FIG. 5 but taken from the tine receiving back end and showing tine receiving side pockets.

Referring to FIGS. 5 and 6, the transverse members 18 and 20, and the longitudinal frame members 26 and 28 generally can be seen. The roller assembly 30 is seen positioned at the front end of the pallet. The side rails and peripheral arms 40, 56, 54 and 52 are seen. The hold down brackets 72 and 74 are seen as well as angle iron 78. The pallet 12 and tine receiving side pockets are seen from FIGS. 5 and 6.

Referring back to FIGS. 5 and 5*a* at each corner there is a roller assembly such as 60. The roller assembly 60 is mounted to the peripheral arm 40 and includes an internal roller carrying tube member or bushing 86 and an external roller 88. The internal tube is welded to the lower lip of the arm 40 and to the upper wall of the arm 40. The roller 88, which extends about the inner tube or bushing 86, is mostly external of the arm 40 although portion of the roller 88 is within the arm 40. Grease is applied between the bushing 86 and roller 88 inner and out members so as to enhance a rolling of roller 88 on the bushing.

Figure 2:
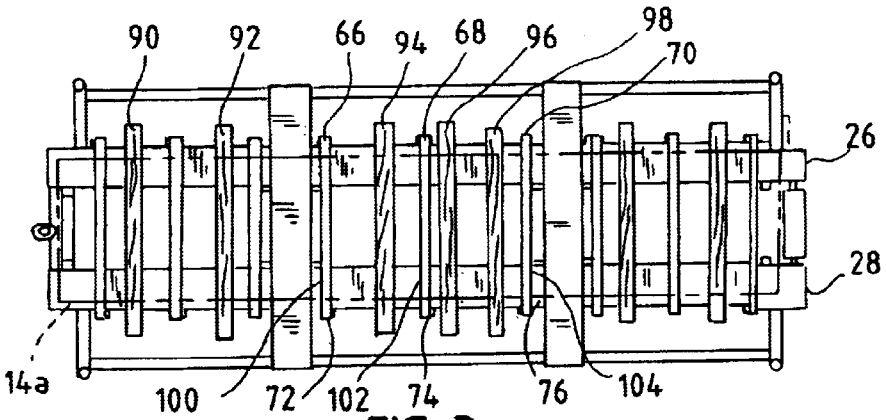
FIG. 2 is a plan view showing a narrow sheet load (e.g. 4'×16") supported on the longitudinal central fra e members and tied down to the pallet.
Figure 3:
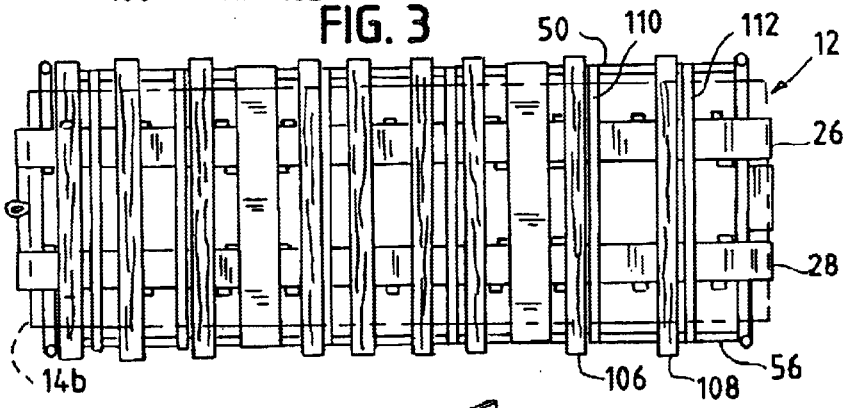
FIG. 3 is a plan view similar to FIG. 2 showing a wide sheet load (6'×16') held down to the pallet along the peripheral rails.
Figure 4:
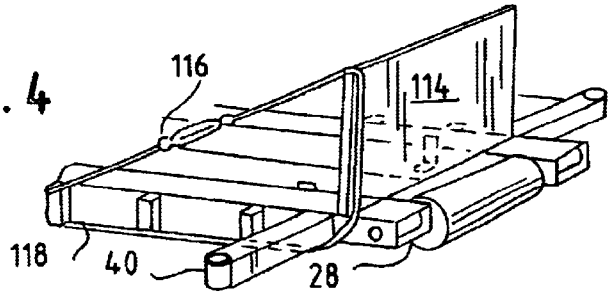
FIG. 4 is a perspective view showing a bulkhead system mounted to the front end of the pallet for restraining forward movement of the lading.

Referring to FIGS. 2 and 3 lading 14*a* is loaded on to the pallet and is sufficiently narrow (4'×16') to be supported by the longitudinal pallet members 26 and 28. Wooden spacers in the form of 4'×4's such as 90, 92, 94, 96, and 98 are positioned between the pallet and the lading so that the lading is in effect spaced above the pallet top surface. In this case, the 4×4 spacers can be supported on the frame or the horizontal portion of the angle irons. Hold down straps extend from the tie down brackets 66, 68 and 70 over the lading and to the other tie down brackets such as 72, 74, and 76. The straps such as 100, 102, and 104 extend from a bracket, such as 66, over the lading and to the bracket 72.

Referring to FIG. 3, if the width of lading 14*b* is greater than the distance between the longitudinal frame members 26 and 28 as for example a 6'×14'sheet, the lading is supported by 4'×4'wooden members such as 106 and 108 which are positioned on the pallet and between the pallet and the lading. The straps such as 110 and 112 grasp the outer peripheral rails such as 50 and 56 and extend over the lading. Thus, the straps are held on the peripheral rails such as 50 and 52 and hold the lading down against the wooden spacers 106 and 108 and the pallet itself.

At the front end of the pallet just behind the roller assembly 30, there is provided a bulkhead 114 which is to restrain the movement of the lading in a forward direction as when the truck carrying the load slows. The bulkhead 114 is held in the vertical position by a chain system such as 116 which extends from the bulkhead to a tie down bracket such as 118 on a longitudinal frame member and then back around the peripheral arm 40 behind the bulk head 114 and to it's beginning. Thus, the chain provides a triangular restraint to hold the bulkhead in the vertical position.

In operation, the sheets are laid on wooden 4×4 spacers which span the longitudinal members 26 and 28 and are generally transverse to the length of the pallet. Straps such as 100, 102, and 104 are used to tie down the lading and hold it against the spacer and pallet. If the load is wide, then straps such as 110 and 112 are used to hold the lading against the spacers by grasping the peripheral side edges of the pallet. At the destination, the pallet is removed by reversing the operation shown in FIG. 1. The forklift tines grasp the back of the pallet and lift it, then the pallet is rolled out of the container and the lading 14 is removed.

The empty pallets 120, 122, 124, 126 and 128 are stacked one on the other for return. It is to be noted that the L-shaped angle irons such as 130 and 132 rise above the surface of the pallet and help in locating the pallet just above. This provides for nesting of the pallets. The stacked pallets can be loaded on a flat bed trailer such as 134 by grasping the lowest pallet in the stack at the side and inserting the forklift tines such as 136 and 138 into the tine receiving pockets in the transverse member, lifting the pallets and placing them on the flatbed.

Figure 15:
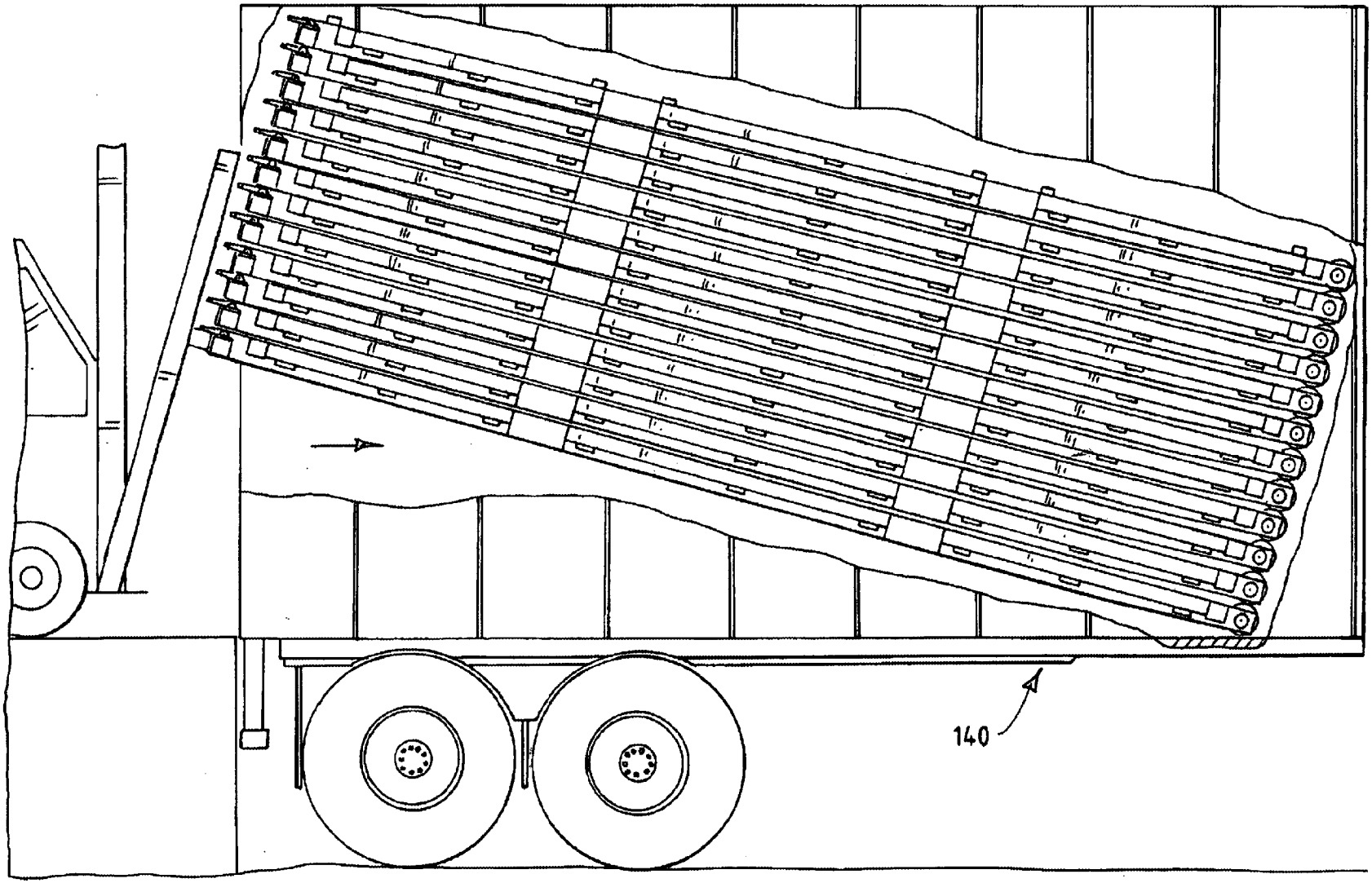
FIG. 15 is an elevational view showing the series of pallets being rolled into a container such as a trailer for return shipment.

In the alternative the pallets can be stacked and then rolled into a container 140 as shown in FIG. 15. Of course the pallets are then lowered into position and are shipped back with a plurality of pallets having been loaded one on top of the other.

Numerous modifications and changes and can be made to the embodiment described herein without the scope of this invention.

What is claimed is:

1. A load-and-roll style pallet which includes:

a rectangular frame that is adapted to carry lading, for positioning on the floor of a lading carrying container and for movement into, out of and within the container;

said frame for supporting the lading defining a top surface, a front end, a back end and a pair of sides;

said frame including a pair of spaced, elongated, and longitudinal frame members extending from the front end to the back end of the pallet;

a pair of spaced elongated and transversely positioned frame members which are at substantially right angles to the longitudinal frame members and extending between the two sides;

peripheral arm members at each of the front and back ends of the frame and each extending outwardly from a respective longitudinal frame member toward an adjacent side and generally parallel to the transverse frame members;

a plurality of side rail members each extending from a respective peripheral arm member to an adjacent transverse frame member, and at least two peripheral side members each extending from one transverse frame member to the other transverse frame member along one side;

a roller system mounted to the frame at the front end, positioned between the longitudinal frame members, rotatably secured to each frame member and having an axis of rotation substantially transverse to each longitudinal frame member and the length of the pallet; and said frame defining at least two pairs of lift pockets one at the back end of the longitudinal frame members, and one on aside one of the sides by the transverse frame members.

2. The load-and-roll pallet of claim 1 wherein there is provided a vertical roller system associated with each corner of the pallet and mounted for rotation about an axis transverse to the pallet.

3. The load-and-roll pallet of claim 2 wherein each vertical roller system is secured to a respective peripheral arm member and positioned along one of the pallet sides.

4. The load-and-roll pallet of claim 1 includes tie down brackets on each longitudinal frame member, said brackets adapted to be engaged by tie down members to hold the lading the place.

5. The load-and-roll style pallet of claim 4 wherein the tie down brackets are U shaped brackets secured to the outboard side of the longitudinal frame members.

6. The load-and-roll pallet of in claim 5 wherein three tie down brackets are mounted on the longitudinal frame members on each outboard side between the front end and the adjacent transverse frame member, between two adjacent transverse members and between the other transverse member and the back end.

7. The load-and-roll pallet of claim 1 wherein an angle iron is associated with each intersection of the transverse frame members and the longitudinal frame members and the front and back end.

8. The load-and-roll pallet of claim 7 wherein the angle iron includes two legs at right angles to each other with the bottom portion of the angle iron parallel to the top surface but positioned downwardly thereof and a vertical leg secured to the longitudinal frame member and extending above the top surface.

9. The load-and-roll style pallet of claim 8 wherein the bottom portion of each angle iron is constructed to carry a lading spacing member adapted to space said lading from said surface.

10. The load-and-roll pallet of claim 9 and in combination therewith plurality of 4'×4' wooden spacers adapted to rest on the L-shaped brackets and space the lading above the top surface.

11. The load-and-roll style pallet of claim 8 wherein the vertical leg of the angle iron is adapted to engage another pallet and cooperate in one pallet nesting with another.

12. The load-and-roll pallet of the type recited in claim 8 and in combination therewith a plurality of similar pallets nesting on top of one another by the upstanding angle iron.

13. The load-and-roll pallet of the type in claim 1 and in combination therewith a plurality of sheets having a width greater than the spacing between the innersides of the longitudinal frame members and less than the distance between the sides.

14. The load-and-roll pallet in combination as in claim 13 wherein each sheet is between 20 and 48 inches wide so that tie down brackets can be used.

15. The load-and-roll pallet of claim 13 wherein each sheet is greater than 48 inches wide so that tie down is to the peripheral frame members.

16. The load-and-roll pallet of claim 1 which includes a lift ring secured to the back end of the pallet.

* * * * *